US007279827B2

(12) United States Patent
Nunome et al.

(10) Patent No.: US 7,279,827 B2
(45) Date of Patent: Oct. 9, 2007

(54) SPARK PLUG WITH ELECTRODE INCLUDING PRECIOUS METAL

(75) Inventors: Kenji Nunome, Nagoya (JP); Osamu Yoshimoto, Nagoya (JP); Wataru Matsutani, Nagoya (JP); Yoshihiro Matsubara, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 277 days.

(21) Appl. No.: 10/519,075

(22) PCT Filed: Mar. 22, 2004

(86) PCT No.: PCT/JP2004/003821

§ 371 (c)(1),
(2), (4) Date: Dec. 23, 2004

(87) PCT Pub. No.: WO2004/107517

PCT Pub. Date: Dec. 9, 2004

(65) Prior Publication Data

US 2006/0043855 A1 Mar. 2, 2006

(30) Foreign Application Priority Data

May 28, 2003 (JP) ..... 2003-151102

(51) Int. Cl.
*H01T 13/20* (2006.01)

(52) U.S. Cl. ..... 313/141; 313/118; 313/143

(58) Field of Classification Search ..... 313/118, 313/141–143

See application file for complete search history.

(56) References Cited

U.S. PATENT DOCUMENTS

| | | | | |
|---|---|---|---|---|
| 6,094,000 | A | 7/2000 | Osamura et al. | 313/141 |
| 6,121,719 | A * | 9/2000 | Matsutani et al. | 313/141 |
| 6,710,523 | B2 * | 3/2004 | Segawa et al. | 313/141 |
| 6,750,598 | B2 * | 6/2004 | Hori | 313/141 |
| 6,831,397 | B2 * | 12/2004 | Kanao et al. | 313/141 |
| 2002/0067111 | A1 * | 6/2002 | Shibata et al. | 313/141 |
| 2003/0038576 | A1 | 2/2003 | Matsutani et al. | 313/141 |
| 2003/0038577 | A1 | 2/2003 | Hori et al. | 313/141 |
| 2003/0122461 | A1 | 7/2003 | Menken et al. | 313/141 |
| 2003/0155849 | A1 * | 8/2003 | Hori | 313/141 |
| 2004/0027042 | A1 | 2/2004 | Matsutani et al. | 313/141 |

FOREIGN PATENT DOCUMENTS

| | | |
|---|---|---|
| EP | 1 231 687 A2 | 8/2002 |
| JP | 09-007733 | 1/1997 |
| JP | 2002 359050 | 12/2002 |
| JP | A-2002-359051 | 12/2002 |
| JP | A-2003-68421 | 3/2003 |

* cited by examiner

*Primary Examiner*—Joseph Williams
*Assistant Examiner*—Kevin Quarterman
(74) *Attorney, Agent, or Firm*—Morgan, Lewis & Bockius LLP

(57) ABSTRACT

An object of the invention is to provide a higher-durability spark plug provided with a center electrode and a side electrode. At least one of the center electrode and the side electrode includes a precious metal member facing a spark discharge gap between the electrodes. A sweating phenomenon of the precious metal member can be suppressed while spark abrasion, oxidation abrasion and abnormal abrasion of the precious metal member are suppressed. The precious metal member contains Ir as a main component, and smaller amounts of Rh, Ru, and Ni.

11 Claims, 8 Drawing Sheets

FIG. 3

| NO. | MELTING | SINTERING | COMPOSITION | ABRASION AMOUNT (mm) | | OXIDATION | GOUGING-OUT | SWEATING | GRAPH 1 | GRAPH 2 | GRAPH 3 |
|---|---|---|---|---|---|---|---|---|---|---|---|
| 1 | ○ | | Ir-0.2Rh-6Ru-1Ni | 0.32 | × | × | ○ | ○ | ○ | | |
| 2 | ○ | | Ir-0.5Rh-6Ru-1Ni | 0.12 | □ | ○ | ○ | ○ | ○ | | |
| 3 | ○ | | Ir-1Rh-6Ru-1Ni | 0.10 | ● | ○ | ○ | ○ | ○ | | |
| 4 | ○ | | Ir-5Rh-6Ru-1Ni | 0.06 | ● | ○ | ○ | ○ | ○ | | |
| 5 | ○ | | Ir-10Rh-6Ru-1Ni | 0.04 | ○ | ○ | ○ | ○ | ○ | | |
| 6 | ○ | | Ir-25Rh-6Ru-1Ni | 0.06 | ● | ○ | ○ | ○ | ○ | | |
| 7 | ○ | | Ir-35Rh-6Ru-1Ni | 0.14 | □ | ○ | ○ | ○ | ○ | | |
| 8 | ○ | | Ir-40Rh-6Ru-1Ni | 0.23 | △ | ○ | ○ | ○ | ○ | | |
| 9 | ○ | | Ir-45Rh-6Ru-1Ni | 0.35 | × | ○ | ○ | ○ | ○ | | |
| 10 | ○ | | Ir-8Rh-3Ru-1Ni | 0.13 | □ | ○ | ○ | × | | ○ | |
| 11 | ○ | | Ir-8Rh-5.2Ru-1Ni | 0.05 | ○ | ○ | ○ | ○ | | ○ | |
| 12 | ○ | | Ir-8Rh-8Ru-1Ni | 0.03 | ○ | ○ | ○ | @ | | ○ | |
| 13 | ○ | | Ir-8Rh-11Ru-1Ni | 0.02 | ○ | ○ | ○ | @ | | ○ | ○ |
| 14 | ○ | | Ir-8Rh-14Ru-1Ni | 0.02 | ○ | ○ | ○ | @ | | ○ | |
| 15 | ○ | | Ir-8Rh-20Ru-1Ni | 0.03 | ○ | ○ | ○ | @ | | ○ | |
| 16 | ○ | | Ir-8Rh-25Ru-1Ni | 0.06 | ● | ○ | ○ | ○ | | ○ | |
| 17 | ○ | | Ir-8Rh-35Ru-1Ni | 0.14 | □ | ○ | ○ | ○ | | ○ | |
| 18 | ○ | | Ir-8Rh-40Ru-1Ni | 0.27 | △ | ○ | ○ | ○ | | ○ | |
| 19 | ○ | | Ir-8Rh-45Ru-1Ni | 0.43 | × | ○ | ○ | ○ | | ○ | |
| 20 | ○ | | Ir-8Rh-11Ru-0.2Ni | 0.08 | ● | ○ | × | @ | | | ○ |
| 21 | ○ | | Ir-8Rh-11Ru-0.4Ni | 0.05 | ○ | ○ | ○ | @ | | | ○ |
| 22 | ○ | | Ir-8Rh-11Ru-3Ni | 0.04 | ○ | ○ | ○ | @ | | | ○ |
| 23 | | ○ | Ir-8Rh-11Ru-5Ni | 0.07 | ● | ○ | ○ | @ | | | ○ |
| 24 | | ○ | Ir-8Rh-11Ru-10Ni | 0.14 | □ | ○ | ○ | @ | | | ○ |
| 25 | | ○ | Ir-8Rh-11Ru-20Ni | 0.31 | × | ○ | ○ | @ | | | ○ |

PRIOR ART

SPARK PLUG WITH ELECTRODE INCLUDING PRECIOUS METAL

This application claims the benefit of the earlier filing date of Japanese Patent Application No. 2003-151102 filed May 28, 2003, which is hereby incorporated by reference in the entirety.

TECHNICAL FIELD

The present invention relates to a spark plug used in an internal combustion engine.

BACKGROUND ART

Recently, an internal combustion engine such as an automobile engine has a tendency toward increase in temperature inside a combustion chamber for the purposes of increase in engine output and improvement in fuel efficiency. An engine of the type having a spark plug (hereinafter also referred to as plug simply) disposed therein in such a manner that a discharge portion of the plug for forming a spark discharge gap is protruded into a combustion chamber has been used widely in order to enhance ignitability. Under such circumstances, a side electrode or a center electrode for forming the discharge portion of the spark plug is apt to be abraded acceleratedly by spark discharge because the discharge portion is exposed to a high temperature. In order to improve resistance to spark abrasion of the discharge portion for forming the spark discharge gap, a large number of proposals have been made for a spark plug of the type in which a precious metal tip mainly containing Pt, Ir, etc. is welded to a leading end of a side electrode or a center electrode.

For example, in Patent Document 1, a spark plug having a precious metal tip mainly containing Ir and Rh has been disclosed. In the precious metal tip of the plug, spark abrasion is suppressed by wise use of an Ir's merit of being high in melting point. In addition, volatilization of Ir oxidized at a high temperature (of not lower than about 900° C.) can be prevented by addition of Rh to Ir, thereby suppressing the oxidation abrasion of the precious metal tip. Accordingly, resistance to abrasion of the precious metal tip at a higher temperature can be improved.

Further, in Patent Document 2, there has been disclosed a plug including a precious metal tip having a predetermined tip diameter D and a thickness H in a discharge portion and containing Ir as a main component, and Rh and Ni as additive components. In the precious metal tip of the plug, like Patent Document 1, volatilization of oxidized Ir can be prevented by addition of Rh to Ir while the Ir's merit of being high in melting temperature is used wisely. Further, there has been disclosed another plug including a precious metal tip further containing Ni as an additive component to suppress abnormal abrasion which is likely to occur in the precious metal tip containing Rh added to Ir, specifically, to suppress an abnormal abrasion phenomenon in which a side portion of the precious metal tip will be abraded to be selectively gouged out from one direction, in accordance with the condition of use.

[Patent Document 1]

Japanese Patent Laid-Open No. 7733/1997

[Patent Document 2]

Japanese Patent Laid-Open No. 2002-359050

DISCLOSURE OF THE INVENTION

It has been however found that the following phenomenon still occurs, in accordance with the condition of use, even in the spark plug including the precious metal tip containing Ir as a main component, and Rh and Ni as additive components as described in Patent Document 2. That is, as shown in a photograph of FIG. 9 and an explanatory view of FIG. 10, while granular substances 201 are deposited on a surface of a precious metal tip 200, a side surface 200S portion of the precious metal tip 200 is abraded as if the precious metal tip 200 sweated (such a phenomenon will be hereinafter referred to as sweating phenomenon). Incidentally, as shown in FIG. 9, the place where a large number of granular substances 201 are deposited is a discharge surface 200T and its vicinity (upper surface in the drawing) located opposite to the other electrode to form a spark discharge gap, especially, a discharge surface-side end portion 200ST of the side surface 200S. In FIG. 9, a left part EA designated by a chain line in (b) with respect to the center of the side surface 100S is particularly abraded.

Although details of the mechanism of generation of such a sweating phenomenon in the precious metal tip are unknown, it is conceived that Ir contained in the abraded portion is volatilized and then the volatilized Ir is coagulated and deposited to grow into granules. Incidentally, the side surface 200S is observed so that grain boundary portions of the precious metal tip are preferentially abraded (particularly see the left part EA with respect to the center).

When the operation of the plug including the precious metal tip 200 is continued, the precious metal tip 200 is abraded more intensively, and at the same time, the granular substances 201 are shaped as if part of the precious metal tip 200 was about to be peeled because the granular substances 201 are grown while integrated with one another so as to hang down like caps of mushrooms. In such a condition, the heat radiation characteristic of the precious metal tip 200 is lowered and the durability of the precious metal tip 200 is further lowered. Moreover, there is a possibility that the grown portions will be lost.

The invention has been accomplished in consideration of the problems. That is, an object of the invention is to provide a higher-durability spark plug provided with a center electrode and a side electrode to form a spark discharge gap between the center electrode and the side electrode, at least one of the center electrode and the side electrode including a precious metal member facing the spark discharge gap, in which a sweating phenomenon of the precious metal member can be suppressed while spark abrasion, oxidation abrasion and abnormal abrasion of the precious metal member can be suppressed.

As a solving means, there is provided a spark plug comprising a center electrode, and a side electrode located on at least one side of the center electrode so that a spark discharge gap is formed between the center electrode and the side electrode, wherein: at least one of the center electrode and the side electrode includes a precious metal member facing the spark discharge gap; and the precious metal member contains Ir as a main component, 0.3 mass % to 43 mass % (both inclusively) of Rh, 5.2 mass % to 41 mass % (both inclusively) of Ru, and 0.4 mass % to 19 mass % (both inclusively) of Ni.

In the spark plug according to the invention, heat resistance is good because the precious metal member included in at least one of the center electrode and the side electrode contains Ir of a high melting point as a main component. Moreover, abrasion of the precious metal member due to volatilization of Ir can be suppressed even at a high temperature since a predetermined amount of Rh is added to the precious metal member. Moreover, abnormal abrasion of the precious metal member can be suppressed even in the condition of use which would cause abnormal abrasion such as gouging-out of a precious metal member of a spark plug in the background art since a predetermined amount of Ni is also added to the precious metal member.

In addition, occurrence of a sweating phenomenon causing abrasion of the precious metal member and deposition of granular substances and occurrence of a peeling phenomenon as a result of the progress of the sweating phenomenon can be suppressed to thereby suppress abrasion and deformation of the precious metal member since a predetermined amount of Ru is added to the precious metal member.

In this manner, the oxidation abrasion, the abnormal abrasion and the sweating phenomenon in the spark plug can be suppressed to make the durability of the spark plug good so that the spark plug exhibits an abrasion amount of not larger than 0.3 mm in a durability test which will be described later.

Incidentally, in the invention, the expression "the precious metal member contains Ir as a main component" means that the Ir content of the precious metal member is not smaller than 50 mass %.

The precious metal member may further contain any material other than Ir, Rh, Ru and Ni.

For example, when Ir, Rh, Ru and Ni are used as the raw materials of the precious metal member, unavoidable impurities (e.g. Si, W, etc.) may be unavoidably and slightly contained in the precious metal member.

In order to further improve resistance to oxidation abrasion, for example, at a high temperature (of not lower than 900° C.) to sustain superiority in another condition of use, for example, Pt, Pd, Re or Os may be contained in the precious metal member.

In order to further improve resistance to oxidation abrasion and resistance to spark abrasion in the case where the temperature of the plug (precious metal member) is relatively low (about 600° C.) to sustain superiority in another condition of use, an oxide (inclusive of a composite oxide) of an element selected from Sr, Y, La, Ce, Pr, Nd, Sm, Eu, Gd, Tb, Dy, Ho, Er, Tm, Yb, Lu, Ti, Zr and Hf can be contained in the precious metal member. Especially, $Y_2O_3$, $La_2O_3$, $ThO_2$ or $ZrO_2$ is preferably used.

Preferably, in the spark plug according to Claim 1, the precious metal member may contain Ir as a main component, 0.5 mass % to 36 mass % (both inclusively) of Rh, 5.2 mass % to 36 mass % (both inclusively) of Ru, and 0.4 mass % to 11 mass % (both inclusively) of Ni.

In the invention, when the composition of the precious metal member in the spark plug is selected to be within the aforementioned range, both oxidation abrasion and abnormal abrasion can be suppressed and the sweating phenomenon can be suppressed while heat resistance is kept high, so that the durability of the precious metal member can be made so good that the precious metal member exhibits an abrasion amount of not larger than 0.15 mm in the durability test which will be described later.

Preferably, in the spark plug according to Claim 1, the precious metal member may contain Ir as a main component, 1.0 mass % to 31 mass % (both inclusively) of Rh, 5.2 mass % to 31 mass % (both inclusively) of Ru, and 0.4 mass % to 7 mass % (both inclusively) of Ni.

In the invention, when the composition of the precious metal member in the spark plug is selected to be within the aforementioned range, both oxidation abrasion and abnormal abrasion can be suppressed and the sweating phenomenon can be suppressed while heat resistance is kept high, so that the durability of the precious metal member can be made so good that the precious metal member exhibits an abrasion amount of not larger than 0.10 mm in the durability test which will be described later.

Preferably, in the spark plug according to Claim 1, the precious metal member may contain Ir as a main component, 6.5 mass % to 22 mass % (both inclusively) of Rh, 5.2 mass % to 24 mass % (both inclusively) of Ru, and 0.4 mass % to 3.5 mass % (both inclusively) of Ni.

In the invention, when the composition of the precious metal member in the spark plug is selected to be within the aforementioned range, both oxidation abrasion and abnormal abrasion can be suppressed and the sweating phenomenon can be suppressed while heat resistance is kept high, so that the durability of the precious metal member can be made so good that the precious metal member exhibits an abrasion amount of not larger than 0.05 mm in the durability test which will be described later.

Preferably, in the spark plug according to any one of Claims 1 through 4, the precious metal member may contain 8 mass % to 20 mass % (both inclusively) of Ru.

According to the invention, both oxidation abrasion and abnormal abrasion can be suppressed while heat resistance is kept high, so that durability can be made so good that the abrasion amount is not larger than 0.3 mm in the durability test which will be described later. In addition, when the Ru content of the precious metal member in the spark plug is selected to be within the aforementioned range, occurrence of the sweating phenomenon causing abrasion of the precious metal member and deposition of the granular substances and occurrence of a peeling phenomenon as a result of the progress of the sweating phenomenon can be suppressed effectively to thereby suppress abrasion and deformation of the precious metal member effectively.

Preferably, in the spark plug according to any one of Claims 1 through 5, the precious metal member may contain at least one of Pt, Pd, Re and Os.

In the invention, when at least one of Pt, Pd, Re and Os is contained in the precious metal member of the spark plug, oxidation abrasion of the precious metal member at a high temperature (of not lower than 900° C.) can be suppressed more greatly.

Preferably, in the spark plug according to any one of Claims 1 through 6, the precious metal member may contain an oxide (inclusive of a composite oxide) of an element selected from Sr, Y, La, Ce, Pr, Nd, Sm, Eu, Gd, Tb, Dy, Ho, Er, Tm, Yb, Lu, Ti, Zr and Hf.

In the invention, when an oxide (inclusive of a composite oxide) of an element selected from Sr, Y, La, Ce, Pr, Nd, Sm, Eu, Gd, Tb, Dy, Ho, Er, Tm, Yb, Lu, Ti, Zr and Hf is further contained in the precious metal member of the spark plug, both oxidation abrasion and spark abrasion of the precious metal member can be suppressed more effectively in the case where the temperature of the precious metal member is relatively low (e.g. about 600° C.).

Incidentally, it is preferable that the amount of the aforementioned element oxide contained is selected to be in a range of from 0.5 mass % to 3 mass %. If the amount of the oxide is smaller than 0.5 mass %, an oxidation volatilization-preventing effect obtained by addition of the oxide cannot be obtained satisfactorily. On the other hand, if the amount of the oxide is larger than 3 mass %, heat resistance of the precious metal member may be spoiled contrariwise.

Preferably, in the spark plug according to Claim 7, the precious metal member may contain at least one of $Y_2O_3$, $La_2O_3$, $ThO_2$ and $ZrO_2$.

In the invention, at least one of $Y_2O_3$, $La_2O_3$, $ThO_2$ and $ZrO_2$ is contained in the precious metal member of the spark plug. As a result, oxidation abrasion of the precious metal member can be suppressed effectively particularly in the case where the temperature of the precious metal member is relatively low (e.g. about 600° C.).

Further, as another solving means, there is provided a spark plug comprising a center electrode, and a side electrode located on at least one side of the center electrode so that a spark discharge gap is formed between the center electrode and the side electrode, wherein: at least one of the center electrode and the side electrode includes a precious metal member facing the spark discharge gap; and the precious metal member contains Ir as a main component, and Rh, Ni and Ru ranging from 8 mass % to 20 mass % (both inclusively).

In the spark plug according to the invention, heat resistance is good since the precious metal member firmly fixed to at least one of the center electrode and the side electrode (ground electrode) contains Ir of a high melting point as a main component. Moreover, abrasion due to volatilization of Ir can be suppressed even at a high temperature since Rh is added to the precious metal member. Moreover, abnormal abrasion can be suppressed even in the condition of use which would cause abnormal abrasion such as gouging-out of a precious metal member of a spark plug in the background art since Ni is also added to the precious metal member.

In addition, occurrence of the sweating phenomenon causing abrasion of the precious metal member and deposition of the granular substances and occurrence of a peeling phenomenon as a result of the progress of the sweating phenomenon can be suppressed effectively to thereby suppress abrasion and deformation of the precious metal member effectively since Ru in the aforementioned range is added to the precious metal member. Thus, in the spark plug, the percentage of a region on which the granular substances are deposited because of the sweating phenomenon can be reduced to 50% or less and the size of the granular substances can be suppressed in the durability test which will be described later. Incidentally, in the invention, the expression "the precious metal member contains Ir as a main component" means that the Ir content of the precious metal member is not smaller than 50 mass %.

Preferably, in the spark plug according to Claim 9, the precious metal member may have an Ni content ranging from an amount not smaller than 0.4 mass % to an amount smaller than the Ru content.

In the invention, when 0.4 mass % or more of Ni is added to the precious metal member, abnormal abrasion can be suppressed satisfactorily. On the other hand, when the Ni content is smaller than the Ru content, the abrasion amount can be suppressed satisfactorily.

Preferably, in the spark plug according to Claim 9 or 10, the precious metal member may have an Rh content ranging from an amount not smaller than 0.3 mass % to an amount not larger than the Ru content.

In the invention, when 0.3 mass % or more of Rh is added to the precious metal member, oxidation abrasion can be suppressed satisfactorily. On the other hand, when the Rh content is not larger than the Ru content, the abrasion amount can be suppressed satisfactorily.

BRIEF DESCRIPTION OF THE DRAWINGS

FIG. 3 is a table showing compositions and test results concerning spark plugs according to Examples and Comparative Examples;

Figure 1:
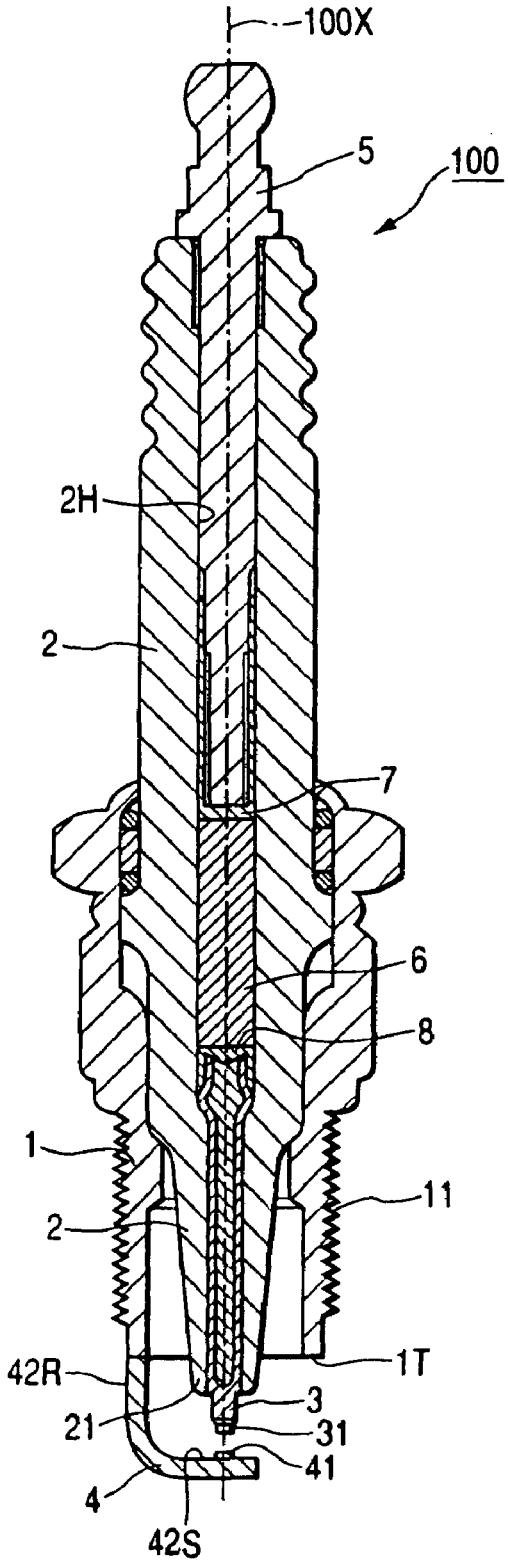
FIG. 1 is a sectional view of a spark plug according to an embodiment.

Incidentally, in the drawings, the reference numeral 100 designates a spark plug; 100X, a center axis (of the spark plug); 1, a metal shell; 1T, a leading end surface; 11, a male threaded portion; 2, an insulator; 21, a leading end portion; 2H, a through-hole; 3, a center electrode; 31, a first discharge portion; 31T, a first discharge surface; 32, a center electrode body; 32T, a body leading end surface; 33, a first precious metal tip; 33T, a first tip leading end surface; 33S, a first tip side surface; 34, a first welded portion; 35, a core body; 4, a side electrode; 41, a second discharge portion; 41T, a second discharge surface; 42, a side electrode body; 42R, a connection portion; 42S, an inner side surface; 43, a second precious metal tip; 43T, a second tip leading end surface; 43S, a second tip side surface; 44, a second welded portion; 5, a terminal attachment; 6, a resistor; and 7, 8, sealing layers of electrically conductive glass, and the reference symbol G designates a spark discharge gap.

BEST MODE FOR CARRYING OUT THE INVENTION

Figure 2A:
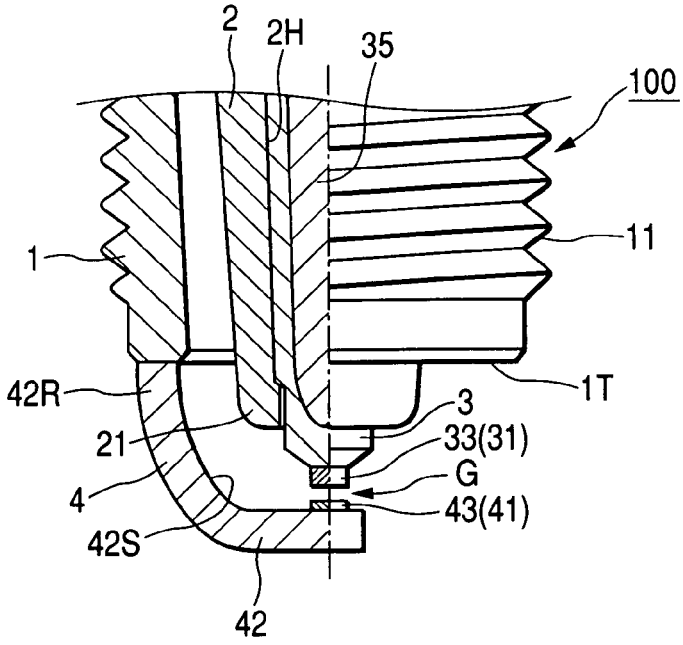
FIG. 2(*a*) is a partly enlarged half-sectional view of the spark plug depicted in FIG. 1, and FIG. 2(*b*) is an enlarged sectional view of main part of the spark plug.
Figure 2B:
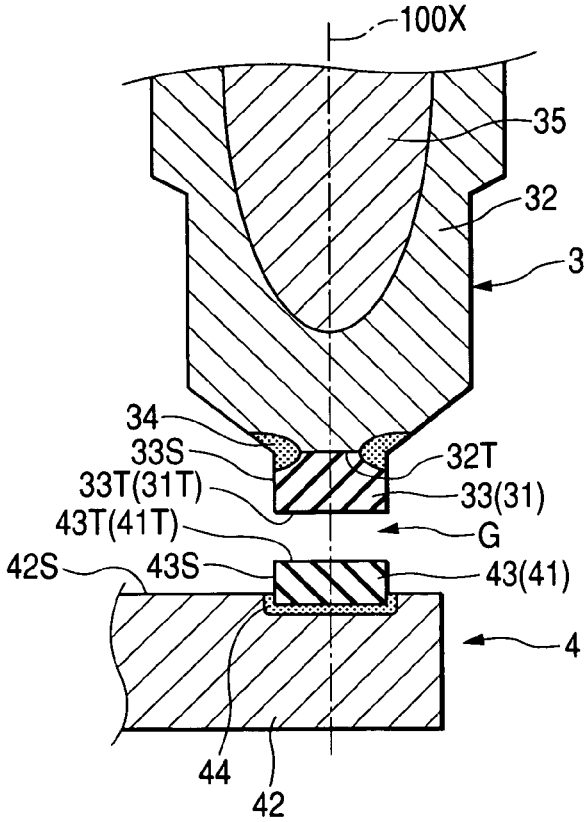

A spark plug according to an embodiment of the invention will be described with reference to FIGS. 1 and 2. FIG. 1 is a longitudinal sectional view of a spark plug 100 according to the embodiment. FIG. 2(*a*) is a partly enlarged half-sectional view of a spark discharge gap G and its vicinity in the spark plug 100. FIG. 2(*b*) is an enlarged sectional view of main part of FIG. 2(*a*).

The spark plug 100 according to the embodiment is a so-called resistor-including spark plug. The spark plug 100 comprises a cylindrical metal shell 1, and an insulator 2 which is fitted into the metal shell 1 so that a leading end portion 21 of the insulator 2 protrudes out from the metal shell 1. The spark plug 100 further comprises a center electrode 3 which is inserted into the insulator 2 so as to be provided inside the insulator 2 in the condition that a first discharge portion 31 formed at a leading end (on the lower side of the drawing) of the center electrode 3 is protruded out from the leading end portion 21 of the insulator 2.

The center electrode 3 includes a core body 35, a center electrode body 32, and a first precious metal tip 33. The core body 35 extends along a center axis 100X of the spark plug 100 and is made of metal good in heat conductivity, such as Cu, a Cu alloy, or the like. The center electrode body 32 is provided to surround the core body 35. The first precious metal tip 33 is welded to a body leading end surface (lower end surface in the drawing) 32T of the center electrode body 32 by a first welded portion 34. The first precious metal tip 33 is shaped like a cylinder 0.6 mm ϕ by 0.8 mm t. The first precious metal tip 33 forms a first discharge portion 31 in the center electrode 3 mainly for the purpose of generating spark discharge. A first tip leading end surface (lower end surface in the drawing) 33T of the first precious metal tip 33 is located opposite to a side electrode 4 which will be described later. The first tip leading end surface 33T forms a first discharge surface 31T of the first discharge portion 31.

The plug 100 further comprises the side electrode (ground electrode) 4. The sides electrode 4 is connected to a leading end surface (lower surface in the drawing) 1T of the metal shell 1 so as to be located on a side (left side in the drawing) of the center electrode 3. The side electrode 4 includes a side electrode body 42 which is welded to the leading end surface 1T of the metal shell 1 at its base end-side connection portion 42R while a leading end of the side electrode body 42 is bent toward the center axis 100X (center electrode 3) side so as to be substantially shaped like an "L" figure. The side electrode 4 further includes a second precious metal tip 43 which is welded to the side electrode body 42 through a second welded portion 44 so as to be provided in an inner side surface 42S of the side electrode body 42 on the center electrode 3 side. The second precious metal 43 is shaped like a disc 0.7 mm ϕ by 0.3 mm t. As shown in FIG. 2(*b*), the second precious metal tip 43 is disposed on the center axis 100X of the plug 100. The second precious metal tip 43 forms a second discharge portion 41 in the side electrode 4 mainly for the purpose of generating spark discharge. A second tip leading end surface 43T (upper end surface in the drawing) of the second precious metal tip 43 is located opposite to the first discharge surface 31T of the center electrode 3 (the first tip leading end surface 33T of the first precious metal tip 33), so that the second tip leading end surface 43T forms a second discharge surface 41T of the second discharge portion 41.

Thus, a spark discharge gap G is formed between the first discharge portion 31 of the center electrode 3 and the second discharge portion 41 of the side electrode 4 (i.e. between the first discharge surface 31T and the second discharge surface 41T). Accordingly, both the first discharge portion 31 of the center electrode 3 (the first precious metal tip 33) and the second discharge portion 41 of the side electrode 4 (the second precious metal tip 43) face the spark discharge gap G so that the gap G is formed between the first and second discharge portions 31 and 41.

Moreover, the side electrode 4 is set to have ground potential because the side electrode 4 is electrically connected to an engine block not shown, through the metal shell 1.

The metal shell 1 is made of metal such as low-carbon steel and shaped like a cylinder. The metal shell 1 forms a housing for the spark plug 100. A male threaded portion 11 for mounting the spark plug 100 into the engine block not shown is formed in an outer circumferential surface of the metal shell 1.

The insulator 2 is made of a ceramic sintered body such as alumina or aluminum nitride. The insulator 2 is a cylindrical body having a through-hole 2H formed therein so as to pierce the cylindrical body along its own axial direction (vertical direction in the drawing). A terminal attachment 5 substantially shaped like a rod is fixedly inserted into one end side (upper side in the drawing) of the through-hole 2H. Likewise, the center electrode 3 is fixedly inserted into the other end side (lower side in the drawing) of the through-hole 2H, as described above. A resistor 6 is disposed in the through-hole 2H and between the terminal attachment 5 and the center electrode 3. Opposite end portions of the resistor 6 are electrically connected to the center electrode 3 and the terminal attachment 5 through sealing layers 7 and 8 of electrically conductive glass respectively. Thus, the terminal attachment 5 and the center electrode 3 are electrically connected to each other through the resistor 6.

The center electrode body 32 of the center electrode 3 is made of an Ni-based heat-resistant alloy such as INCONEL 600 (registered trademark of Inco Europe Limited in the United Kingdom) or an Fe-based heat-resistant alloy. The side electrode body 42 of the side electrode 4 is made of an Ni-based heat-resistant alloy such as INCONEL 600 or INCONEL 601.

As shown in FIGS. 1 and 2, the plug 100 according to the embodiment has a structure in which part of the center electrode body 32 protrudes out from the leading end portion 21 of the insulator and in which the first precious metal tip 33 is welded to a leading end of the center electrode body 32. For this reason, the distance from the first precious metal tip 33 to the core body 35 for dissipating heat is apt to be large. Thus, when the plug 100 is in use, heat flowing into the first precious metal tip 33 (the first discharge portion 31) can be hardly radiated, so that the temperature of the first precious metal tip 33 is apt to be high.

Since the second precious metal tip 43 (the second heat radiating portion 41) is firmly fixed to the side electrode body 42 made of an Ni alloy-based heat resistant alloy lower in heat conductivity than Cu or the like, heat can be hardly radiated from the second precious metal tip 43, so that the temperature of the second precious metal tip 43 is also apt to be high in use.

Incidentally, in order to improve heat radiation characteristic of the second precious metal tip 43, a side electrode body internally having a core body made of Cu or a Cu alloy may be used as the side electrode body 42.

In any case, the temperature of the first precious metal tip 33 and the temperature of the second precious metal tip 43 are apt to be high. It is therefore necessary to use precious metal tips having compositions prepared in consideration of not only abrasion caused by spark discharge but also oxidation abrasion caused by volatilization of Ir oxidized at a high temperature, abnormal abrasion, etc. in the plug 100.

In the embodiment, therefore, as shown in the table of FIG. 3, 25 kinds of Ir-based alloys in total were prepared for the first and second precious metal tips 33 and 43 forming the first and second discharge portions 31 and 41. Each of the Ir-based alloys contained Ir as a main component and contained Rh, Ri and Ni at various composition ratios. Thus, 25 kinds of sample plugs 100 were produced. Incidentally, precious metal having the same composition was used for the first and second precious metal tips 33 and 43 in each of the sample plugs 100.

The first and second precious metal tips 33 and 43 were formed by a melting method or a sintering method in accordance with the composition of the tips 33 and 43. When the melting method was selected from these methods, powdered precious metals as raw materials were blended at a desired ratio, melted once and then cooled to form an alloy ingot. Arc melting was used as a specific example of the melting method. Incidentally, other examples of the melting method include plasma beam melting, high frequency induction melting, and soon. If a water-cooled casting method or the like is used so that liquid (molten metal) of a precious metal alloy is cast and quenched to form an ingot, segregation of the alloy can be reduced. Accordingly, this method may be also used.

After the obtained ingot of the precious metal alloy was then processed into a rod-like material by hot forging, the diameter of the rod-like material was further reduced by hot rolling using a grooved pressure roll and hot swaging and the rod-like material was finally processed into a precious metal wire material having a desired wire diameter by hot wire drawing. Then, the precious metal wire material was cut to have a desired thickness. In this manner, each of the first and second precious metal tips 33 and 43 was obtained.

Incidentally, the first and second precious metal tips 33 and 43 may be obtained from the precious metal alloy ingot in the following manner other than the aforementioned manner. The precious metal alloy ingot is processed into a wire-like or rod-like material by one kind or a combination of two or more kinds selected from hot forging, hot rolling and hot wire drawing, and then, the wire-like or rod-like material is cut into pieces with a predetermined length in a longitudinal direction.

Or the precious metal alloy ingot may be processed into a plate-like material by hot rolling, and then the plate-like material may be punched into a predetermined tip shape by hot punching. Or a globular precious metal alloy may be produced by a known atomizing method and compressed by press or flat dices to form flat or cylindrical first and second precious metal tips 33 and 43.

On the other hand, when the sintering method was selected, powdered precious metals blended at a desired ratio and containing PVA (binder) as an additive were compression-molded by mold-press molding and then calcined at about 1000° C. in a hydrogen atmosphere to remove the binder. Then, the calcined material was sintered at about 2100° C. in a hydrogen atmosphere to form an alloy ingot. Although both calcining and sintering were carried out in a hydrogen atmosphere, they may be carried out in an argon atmosphere or in a vacuum. Alternatively, the powdered precious metals may be compression-molded by CIP molding or may be sintered by HIP molding while pressure is applied to the powdered precious metals. Which of the melting method and the sintering method was used for obtaining the precious metal alloy is described in the table shown in FIG. 3. Specifically, precious metal tips used in plug Nos. 1 to 22 were produced by the melting method whereas precious metal tips used in plug Nos. 23 to 25 were produced by the sintering method.

Each of the sample plugs 100 was produced by a known method. Specifically, first, a first precious metal tip 33 was welded to a center electrode body 32. More in particular, a disc-like first precious metal tip 33 was superposed on a leading end surface 32T of a center electrode body 32. Then, a neighborhood of a contact portion of a first tip side surface 33S of the first precious metal tip 33 being in contact with the center electrode body 32 was irradiated circumferentially with a laser beam to thereby form a first welded portion 34 shaped like a ring. In this manner, the first precious metal tip 33 was welded to the leading end surface 32T of the center electrode body 32 (see FIG. 2(*b*)).

Incidentally, energy beam welding such as electron-beam welding other than the laser welding maybe used in consideration of the materials, sizes, etc. of the center electrode body 32 and the first precious metal tip 33. Or electric resistance welding may be used so that the whole end surface of the first precious metal tip 33 is melted and welded to the center electrode body 32.

Then, the center electrode 3 was inserted into a through-hole 2H of an insulator 2 so that the first precious metal tip 33 and part of the center electrode body 32 protrude out from a leading end portion 21 of the insulator 2. Further, a sealing glass member, a resistor 6, a sealing glass member and a terminal attachment 5 were inserted successively into the through-hole 2H and on the rear end side of the center electrode 3 and then heated. As a result, the sealing glass members were melted to form sealing layers 7 and 8 of electrically conductive glass, and the center electrode 3, the resistor 6, and the terminal attachment 5 were firmly fixed into the through-hole 2H.

Then, a metal shell 1 to which a side electrode 4 had been welded in the condition that the side electrode 4 had been not bent yet was attached to the insulator 2. Further, a second precious metal tip 43 was welded to the side electrode 4. Specifically, a second welded portion 44 was formed in a predetermined position of an inner side surface 42S of an unbent side electrode body 42 by resistance welding. Then, the side electrode 4 was bent. Moreover, the bending state of the side electrode body 42 was adjusted so that a second tip leading end surface 43T was located opposite to the first tip leading end surface 33T, and that a spark discharge gap G with a predetermined size was formed. In this manner, the plug 100 was completed.

Incidentally, the second precious metal tip 43 may be connected to the side electrode body 42 in another manner such as laser welding or both resistance welding and laser welding after the resistance welding than the aforementioned manner in which the second precious metal tip 43 was connected to the side electrode body 42 by resistance welding.

EXAMPLES

The following test was conducted on the aforementioned sample plugs 100. Specific contents of the test were as follows. That is, each spark plug 100 was mounted in a (six-cylinder) gasoline engine of 2000 cc displacement. The engine was operated up to 300 hours accumulatively while kept in the full throttle condition and at an engine rotational speed of 5000 rpm. Leadless gasoline was used as fuel. The temperature of the leading end of the center electrode was 900° C. At the beginning of the test, the spark discharge gap G of each spark plug was set at 1.1 mm.

After the test; the spark discharge gap G was measured. The amount of abrasion of the first and second precious metal tips 33 and 43 (hereinafter simply referred to as precious metal tips 33 and so on) was calculated. Meanwhile, the presence of abnormal abrasion (gouging-out) and the presence of a sweating phenomenon in the precious metal tips 33 and so on were visually observed with an optical microscope. Thus, results shown in the table of FIG. 3 were obtained (see FIG. 4).

Moreover, precious metal samples the same in composition as the aforementioned precious metal tip 33 were used so that the presence of oxidation abrasion was examined by the following test. That is, precious metal samples the same in composition as the first and second precious metal tips 33 and 43 were heated to 1100° C. in the atmospheric air and left for 20 hours. The weight of each precious metal sample was measured before and after the test, so that the weight survival rate of the precious metal sample was calculated.

In the table of FIG. 3, the column "Composition" indicates the composition of the first and second precious metal tips used in each sample plug 100. The number affixed to each element or oxide indicates the composition rate (mass %) of the element (or oxide). For example, the composition (Ir-0.2Rh-6Ru-1Ni) of the precious metal tip No. 1 indicates that the precious metal tip No. 1 contains 0.2 mass % of Rh, 0.6 mass % of Ru, 1.0 mass % of Ni, and the residual amount of Ir.

Further, the column "Abrasion Amount" indicates the amount of increase in the spark discharge gap G of the spark plug compared with the spark discharge gap G at the beginning of the test. Incidentally, the spark discharge gap G is the smallest distance between the first discharge surface 31T and the second discharge surface 41T. Further, in the table of FIG. 3, the amounts of abrasion are classified into five sections of ○, ●, □, Δ, and x in the following manner. Here, "○" indicates the case where the abrasion amount is not larger than 0.05 mm, "●" indicates the case where the abrasion amount is larger than 0.05 mm but not larger than 0.10 mm, "□" indicates the case where the abrasion amount is larger than 0.10 mm but not larger than 0.15 mm, "Δ" indicates the case where the abrasion amount is larger than 0.15 mm but not larger than 0.30 mm, and "x" indicates the case where the abrasion amount is larger than 0.30 mm.

Further, the column "Oxidation" in the table shows evaluation concerning oxidation abrasion. The case where the aforementioned weight survival rate is not smaller than 90% is evaluated as "○", and the case where the weight survival rate is smaller than 90% is evaluated as "x". Further, the column "Gouging-Out" shows evaluation concerning abnormal abrasion expressing a state in which part of the precious metal tip side surface 33S, 43S is selectively abraded so as to be gouged out. The case where no abnormal abrasion occurred is evaluated as "○", and the case where abnormal abrasion occurred is evaluated as "x". Further, the column "Sweating" shows the presence of a sweating phenomenon in which granular substances were generated in a part of the precious metal tip while the other part of the precious metal tip was abraded. The case where the region on which granular substances were deposited occupied 50% or less of the area of the precious metal tip side surface 33S, 43S is evaluated as "○" (especially, in the case evaluated as "○", the case where the size of the granular substances was small is evaluated as "@"), and the case where the region on which granular substances were deposited occupied over 50% of the area of the precious metal tip side surface 33S, 43S is evaluated as "x".

According to the table of FIG. 3, it is proved that oxidation abrasion occurred in only the plug No. 1 evaluated as "x" concerning oxidation abrasion (in the column "Oxidation") The reason is understood as follows. That is, since the composition of the precious metal tips 33 and so on used in the plug No. 1 was Ir-0.2Rh-6Ru-1Ni and contained a small amount of Rh, volatilization of oxidized Ir could not be suppressed sufficiently so that oxidation abrasion occurred in the precious metal tips. That is, the result indicates that the Rh content of 0.2 mass % was insufficient to suppress the oxidation abrasion.

Incidentally, when the oxidation abrasion occurred, the precious metal tips 33 and so on were abraded from the sides of the first and second discharge surfaces 31T and 41T. For this reason, the abrasion amount of the plug No. 1 took a large value of 0.32 mm, so that the plug No. 1 was evaluated as "x" in the evaluation of the abrasion amount.

It is also proved that abnormal abrasion occurred in only the plug No. 20 evaluated as "x" concerning abnormal abrasion (in the column "Gouging-Out"). The reason is understood as follows. That is, since the composition of the precious metal tips 33 and so on used in the plug No. 20 was Ir-8Rh-11Ru-0.2Ni and contained a small amount of Ni, the abnormal abrasion of the precious metal tips could not be suppressed sufficiently so that the abnormal abrasion resulting in gouged-out of the precious metal tips occurred. That is, the-result indicates that the Ni content of 0.2 mass % was insufficient to suppress the abnormal abrasion.

The sides of the first and second discharge surfaces 31T and 41T of the precious metal tips 33 and so on were however not abraded so much even when the abnormal abrasion occurred. For this reason, the abrasion amount of the plug No. 20 took a small value of 0.08 mm, so that the plug No. 20 was evaluated as "○" in the evaluation of the abrasion amount.

It is further proved that a sweating phenomenon occurred intensively in only the plug No. 10 evaluated as "x" concerning the sweating phenomenon (in the column "Sweating"). The reason is understood as follows. That is, since the composition of the precious metal tips 33 and so on used in the plug No. 10 was Ir-8Rh-3Ru-1Ni and contained a small amount of Ru, the sweating phenomenon of the precious metal tips could not be suppressed sufficiently so that the sweating phenomenon occurred intensively in the precious metal tips. That is, the result indicates that the Ru content of 3.0 mass % was insufficient to suppress the sweating phenomenon.

The sides of the first and second discharge surfaces 31T and 41T of the precious metal tips 33 and so on were however not abraded so much even when the sweating phenomenon occurred. For this reason, the abrasion amount of the plug No. 10 took a relatively small value of 0.13 mm so that the plug No. 10 was evaluated as "Δ" in the evaluation of the abrasion amount.

On the other hand, it is proved that the plugs Nos. 12 to 15 and Nos. 20 to 25 evaluated as "@" were prevented from sweating. From this fact, it is proved that the sweating phenomenon was suppressed effectively when the Ru content was in a range of from 8 mass % to 20 mass % and was larger than the Ni content and larger than the Rh content, that is, when the Ru content was in the aforementioned range and was the second largest next to the Ir content.

Figure 4:
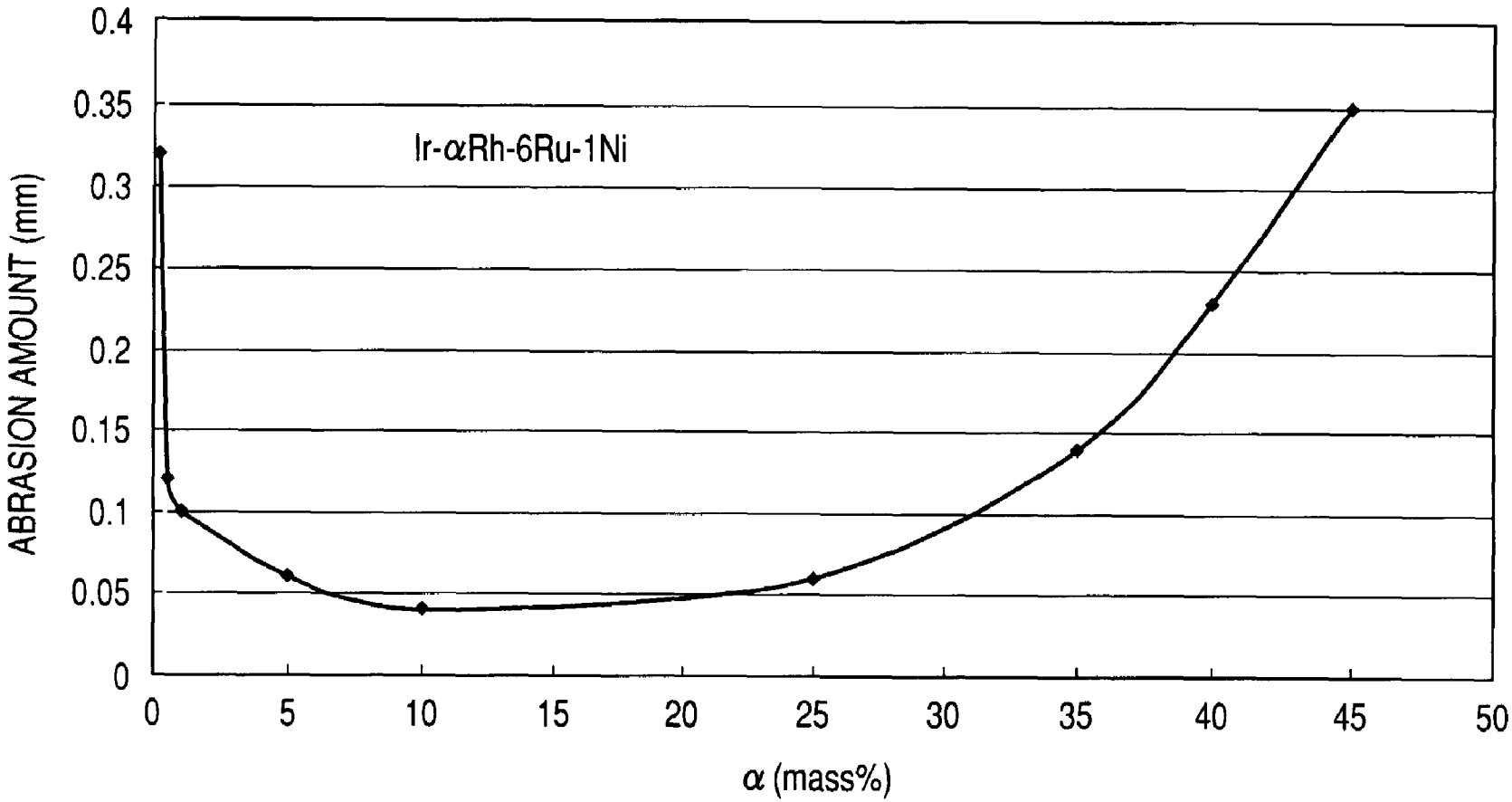
FIG. 4 is a graph 1 showing the relation between the Rh content α and the amount of abrasion concerning some plugs having compositions represented by Ir-αRh-6Ru-1Ni among Examples and Comparative Examples shown in the table of FIG. 3.
Figure 5:
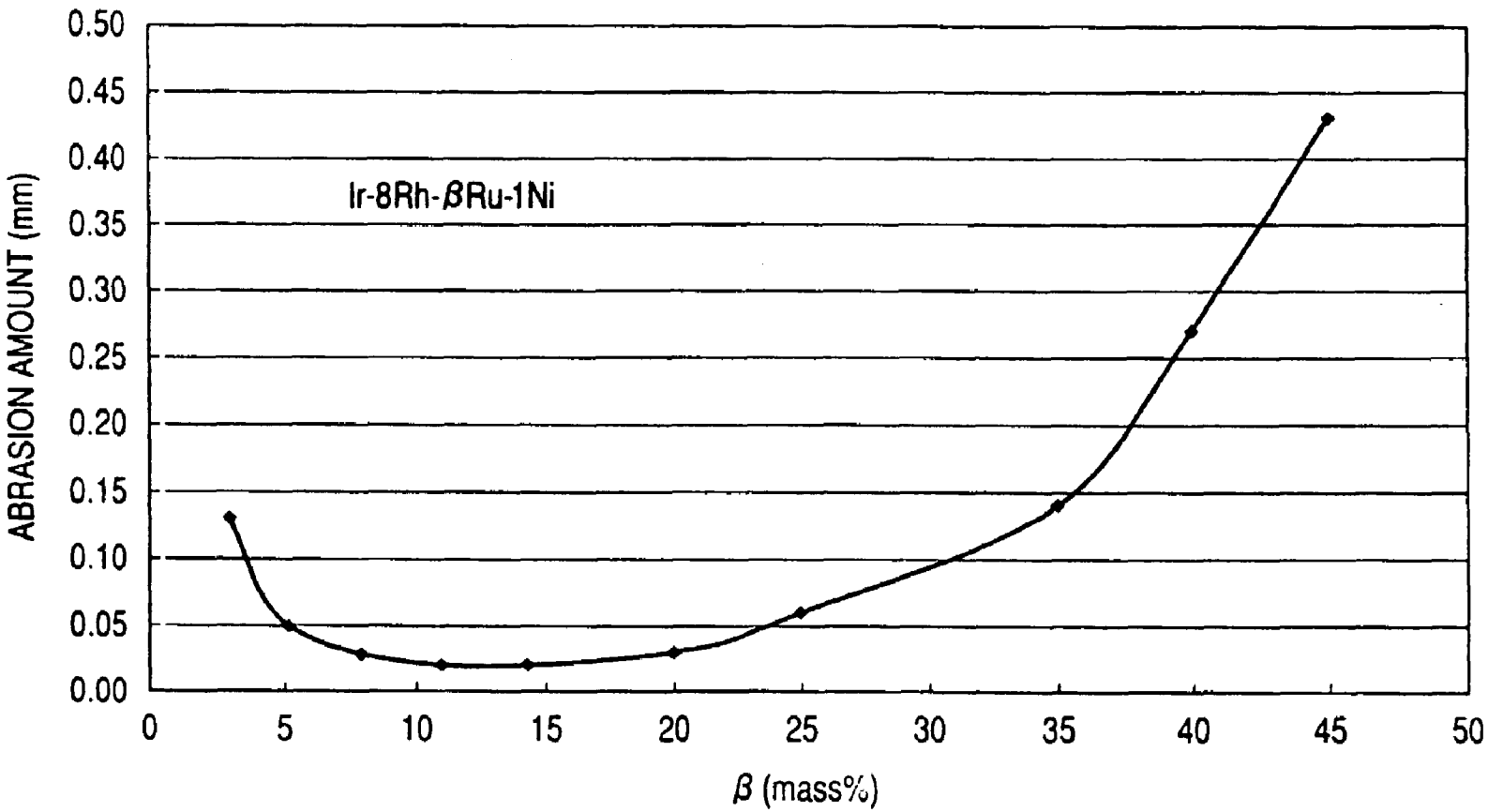
FIG. 5 is a graph 2 showing the relation between the Ru content β and the amount of abrasion concerning some plugs having compositions represented by Ir-8Rh-βRu-1Ni among Examples and Comparative Examples shown in the table of FIG. 3.
Figure 6:
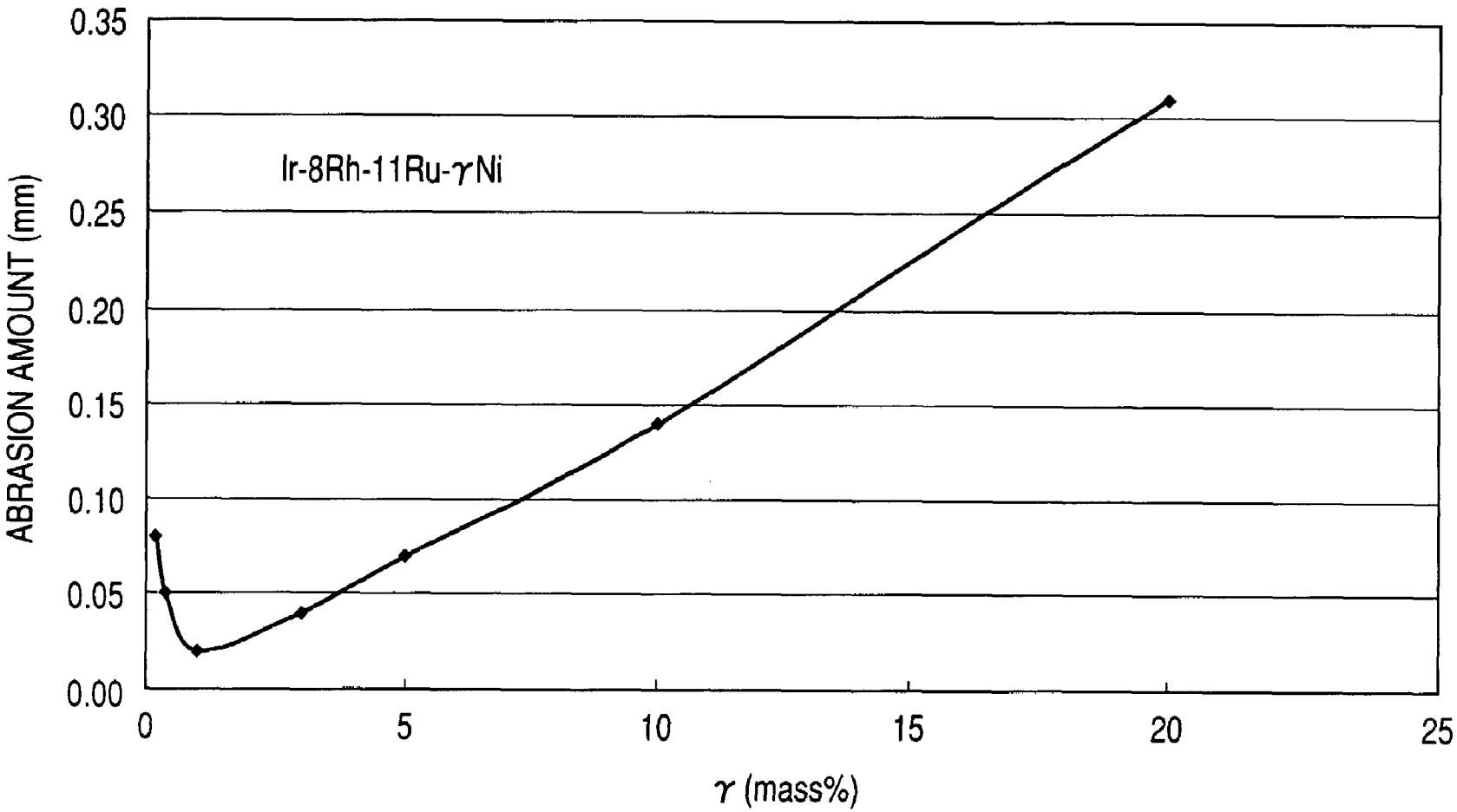
FIG. 6 is a graph 3 showing the relation between the Ni content γ and the amount of abrasion concerning some plugs having compositions represented by Ir-8Rh-11Ru-γNi among Examples and Comparative Examples shown in the table of FIG. 3.

Further, results concerning the abrasion amount are shown in graphs 1 to 3 (FIGS. 4 to 6).

The graph 1 shown in FIG. 4 is a graph showing the relation between the Rh content α and the abrasion amount concerning some sample plugs 100 (Nos. 1 to 9) using precious metal tips 33 and so on having compositions represented by Ir-αRh-6Ru-1Ni among Examples and Comparative Examples shown in the table of FIG. 3.

With reference to the graph 1, it is proved that an abrasion amount of not larger than 0.30 mm (evaluated as "Δ" or better) can be obtained when the Rh content α of the precious metal tips 33 and so on is set to be not smaller than 0.3 mass % and not larger than 43 mass %.

On the other hand, the graph 2 shown in FIG. 5 is a graph showing the relation between the Ru content β and the abrasion amount concerning some plugs 100 (Nos. 10 to 19) using precious metal tips 33 and so on having compositions represented by Ir-8Rh-βRu-1Ni among Examples and Comparative Examples shown in the table of FIG. 3.

With reference to the graph 2, it is proved that an abrasion amount of not larger than 0.30 mm (evaluated as "Δ" or better) can be obtained when the Ru content β of the precious metal tips 33 and so on is set to be not larger than 43 mass %. On the other hand, as described above, the Ru content of 3.0 mass % (see No. 10) is insufficient in consideration of the sweating phenomenon. The sweating phenomenon, however, did not occur when the Ru content was 5.2 mass % (see No. 11). Accordingly, it is proved that the Ru content β is preferably set to be not smaller than 5.2 mass %.

Further, the graph 3 shown in FIG. 6 is a graph showing the relation between the Ni content γ and the abrasion amount concerning some plugs 100 (No. 12 and Nos. 20 to 25) using precious metal tips 33 and so on having compositions represented by Ir-8Rh-11Ru-γNi among Examples and Comparative Examples shown in the table of FIG. 3.

With reference to the graph 3, it is proved that an abrasion amount of not larger than 0.30 mm (evaluated as "Δ" or better) can be obtained when the Ni content γ of the precious metal tips 33 and so on is set to be not smaller than 19 mass %. On the other hand, as described above, the Ni content of 0.2 mass % (see No. 20) is insufficient in consideration of abnormal abrasion. The abnormal abrasion, however, did not occur when the Ni content was 0.4 mass % (see No. 21). Accordingly, it is proved that the Ni content is preferably set to be not smaller than 0.4 mass %.

Accordingly, from these facts, it is proved that a composition containing Ir as a main component, 0.3 mass % to 43 mass % (both inclusively) of Rh, 5.2 mass % to 41 mass % (both inclusively) of Ru, and 0.4 mass % to 19 mass % (both inclusively) of Ni is suitable for the composition of the precious metal tips 33 and so on to make it possible to suppress oxidation abrasion, abnormal abrasion and the sweating phenomenon and make the durability so high that the amount of abrasion of the precious metal tips 33 and so on can be reduced to 0.30 mm or less in the aforementioned durability test.

Likewise, according to the graphs 1 to 3 shown in FIGS. 4 to 6, it is proved that the amount of abrasion of the precious metal tips 33 and so on can be reduced to 0.15 mm or less (evaluated as "□" or better) when the Rh content α of the precious metal tips 33 and so on is set to be not smaller than 0.5 mass % and not larger than 36 mass %. It is also proved that the Ru content β is preferably selected to be not larger than 36 mass %. If the sweating phenomenon is also taken into consideration as described above, it is proved that the Ru content β is preferably selected to be not smaller than 5.2 mass % and not larger than 36 mass %. It is also proved that the Ni content γ is preferably selected to be not larger than 11 mass %. If the abnormal abrasion is also taken into consideration as described above, it is proved that the Ni content γ is preferably selected to be not smaller than 0.4 wt % and not larger than 11 mass %.

Accordingly, from these facts, it is proved that a composition containing Ir as a main component, 0.5 mass % to 36 mass % (both inclusively) of Rh, 5.2 mass % to 36 mass % (both inclusively) of Ru, and 0.4 mass % to 11 mass % (both inclusively) of Ni is suitable for the composition of the precious metal tips 33 and so on to make it possible to suppress oxidation abrasion, abnormal abrasion and the sweating phenomenon and make the durability so high that the amount of abrasion of the precious metal tips 33 and so on can be reduced to 0.15 mm or less in the aforementioned durability test.

Further, according to the graphs 1 to 3 shown in FIGS. 4 to 6, it is proved that the amount of abrasion of the precious metal tips 33 and so on can be reduced to 0.10 mm or less (evaluated as "●" or better) when the Rh content α of the precious metal tips 33 and so on is selected to be not smaller than 1.0 mass % and not larger than 31 mass %. It is also proved that the Ru content β is preferably selected to be not larger than 31 mass %. If the sweating phenomenon is also taken into consideration as described above, it is proved that the Ru content β is preferably selected to be not smaller than 5.2 mass % and not larger than 31 mass %. It is also proved that the Ni content γ is preferably selected to be not larger than 7 mass %. If abnormal abrasion is also taken into consideration as described above, it is proved that the Ni content γ is preferably selected to be not smaller than 0.4 wt % and not larger than 7 mass %.

Accordingly, from these facts, it is proved that a composition containing Ir as a main component, 1.0 mass % to 31 mass % (both inclusively) of Rh, 5.2 mass % to 31 mass % (both inclusively) of Ru, and 0.4 mass % to 7 mass % (both inclusively) of Ni is suitable for the composition of the precious metal tips 33 and so on to make it possible to suppress oxidation abrasion, abnormal abrasion and the sweating phenomenon and make the durability so high that the amount of abrasion of the precious metal tips 33 and so on can be reduced to 0.10 mm or less in the aforementioned durability test.

Further, according to the graphs 1 to 3 shown in FIGS. 4 to 6, it is proved that the amount of abrasion of the precious metal tips 33 and so on can be reduced to 0.05 mm or less (evaluated as "○" or better) when the Rh content α of the precious metal tips 33 and so on is selected to be not smaller than 6.5 mass % and not larger than 22 mass %. It is also proved that the Ru content β is preferably selected to be not larger than 24 mass %. If the sweating phenomenon is also taken into consideration as described above, it is proved that the Ru content β is preferably selected to be not smaller than 5.2 mass % and not larger than 24 mass %. It is also proved that the Ni content γ is preferably selected to be not larger than 3.5 mass %. If abnormal abrasion is also taken into consideration as described above, it is proved that the Ni content γ is preferably selected to be not smaller than 0.4 wt % and not larger than 3.5 mass %.

Accordingly, from these facts, it is proved that a composition containing Ir as a main component, 6.5 mass % to 22 mass % (both inclusively) of Rh, 5.2 mass % to 24 mass % (both inclusively) of Ru, and 0.4 mass % to 3.5 mass % (both inclusively) of Ni is suitable for the composition of the precious metal tips 33 and so on to make it possible to suppress oxidation abrasion, abnormal abrasion and the sweating phenomenon and make the durability so high that the amount of abrasion of the precious metal tips 33 and so on can be reduced to 0.05 mm or less in the aforementioned durability test.

Figure 7:
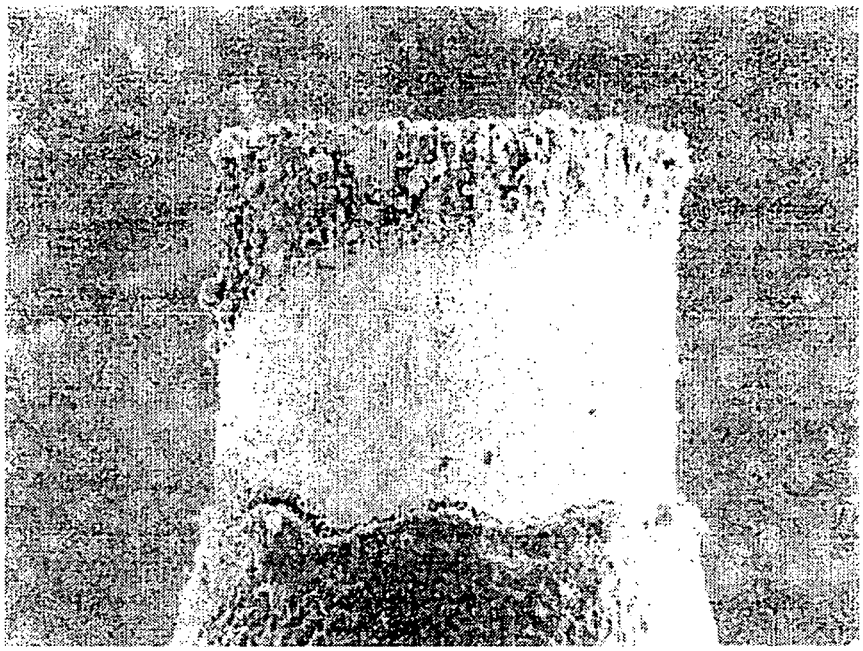
FIG. 7 is a photograph showing an example of a precious metal tip of the spark plug according to the embodiment after a durability test.
Figure 8:
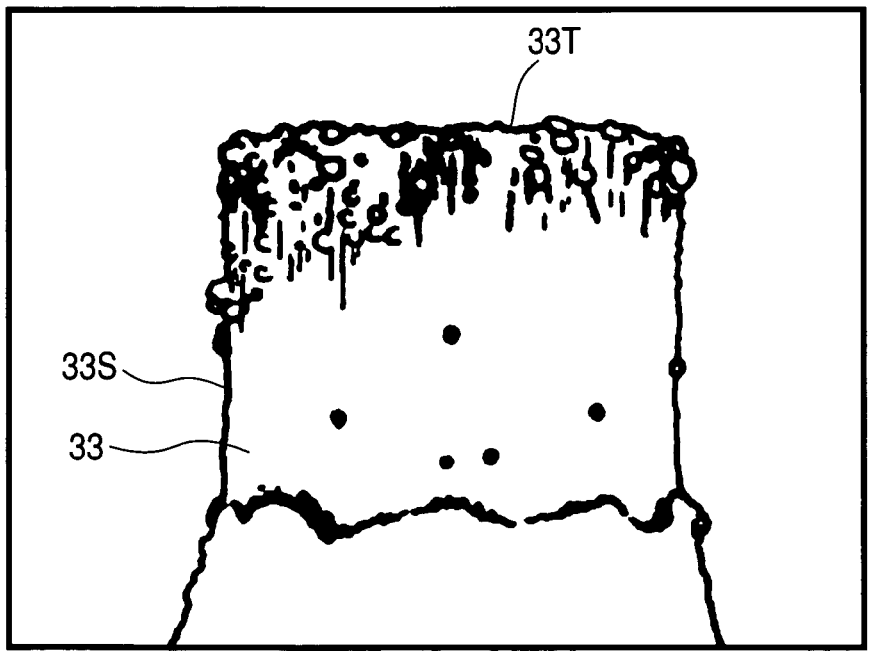
FIG. 8 is an explanatory view of the precious metal tip depicted in FIG. 7.

Incidentally, FIGS. 7 and 8 show a photograph and an explanatory view of the first precious metal tip 33 of the plug No. 12 as an example of the form of the first precious metal tip 33 after the durability test.

Figure 9:
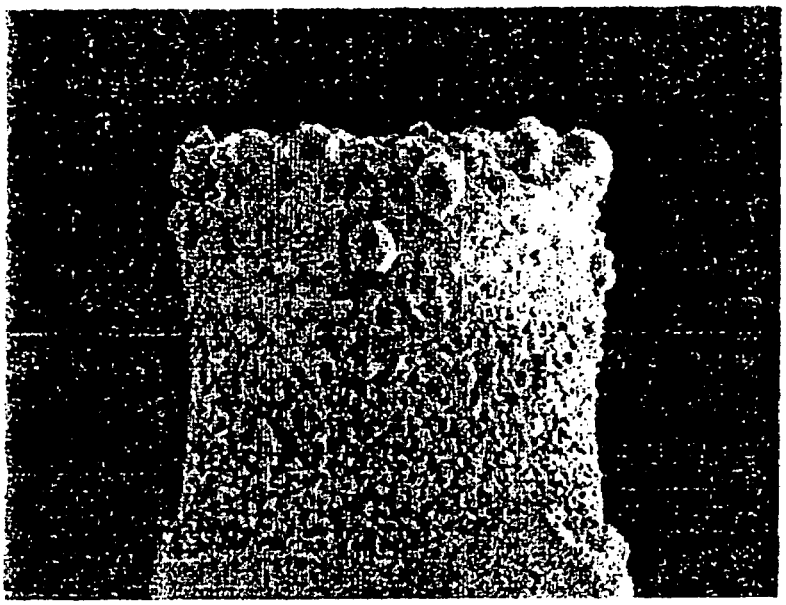
FIG. 9 is a photograph showing a precious metal tip of a spark plug according to the background art after the durability test.
Figure 10:
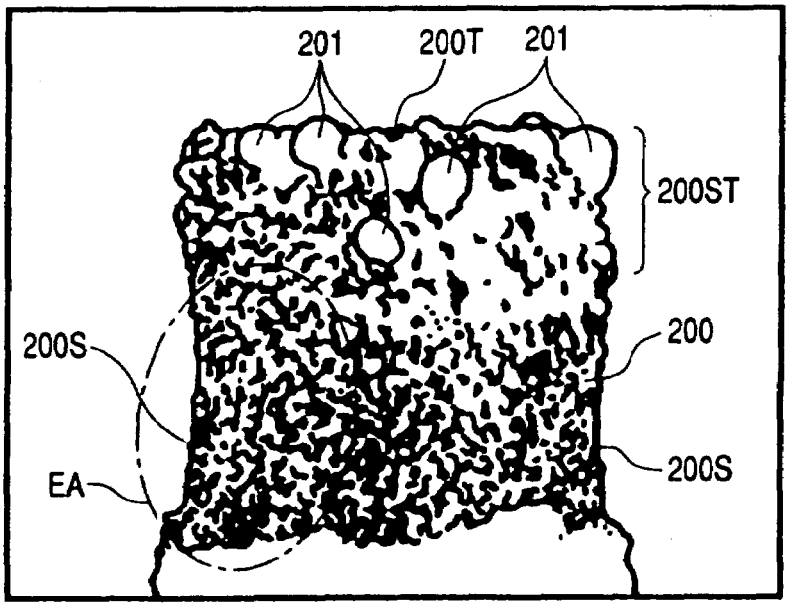
PRIOR ART FIG. 10
FIG. 10 is an explanatory view of the precious metal tip depicted in FIG. 9.

As can be understood easily from comparison with a photograph and an explanatory view shown in FIGS. 9 and 10, the corner portion between the first tip leading end surface 33T (upper surface in the drawings) and the first tip side surface 33S in the first precious metal tip 33 of the plug No. 12 is not round, so that it is apparent that spark abrasion and oxidation abrasion due to the durability test is extremely small. Moreover, the first tip side surface 33S substantially keeps its cylindrical shape, so that occurrence of abnormal abrasion to gouge out the first tip side surface 33S is not found. In addition, the amount of deposition of the granular substances is very small, so that it is apparent the sweating phenomenon little occurs. Thus, it is proved that oxidation abrasion, abnormal abrasion and further the sweating phenomenon can be suppressed while the amount of abrasion can be reduced when the aforementioned amounts of Ir, Rh, Ru and Ni are contained.

Although the invention has been described in detail and with reference to a specific embodiment, it is apparent to those skilled in the art that various changes and modifications may be made without departing from the sprit and scope of the invention.

This application is based on a Japanese patent application filed on May 28, 2003 (Japanese Patent Application No. 2003-151102), the contents of which are incorporated herein by reference.

INDUSTRIAL APPLICABILITY

While the invention has been described above based on an embodiment, it is a matter of course that the invention is not limited to the embodiment, and that any suitable modification of the embodiment may be used without departing from the gist of the invention.

For example, in the aforementioned embodiment, there is used the plug 100 in which the first precious metal tip 33 is welded to the center electrode body 32 and in which the second precious metal tip 43 is welded to the side electrode body 42. It is however unnecessary to use the precious metal tips. For example, the whole of the side electrode 4 maybe made of precious metal having a predetermined composition.

In the aforementioned embodiment, there is used the plug 100 in which the precious metal tips 33 and so on are provided in the center electrode body 32 and the side electrode body 42 respectively. The invention may be however applied to a plug in which a precious metal tip is provided either in the center electrode body 32 or in the side electrode body 42.

Or in the aforementioned embodiment, precious metal having the same composition is used both in the first precious metal tip 33 and in the second precious metal tip 43. Compositions of precious metal tips connected to the center electrode 3 and the side electrode 4 respectively maybe however made different from each other in consideration of the difference between the center electrode 3 and the side electrode 4. Further, when different compositions are used in the first precious metal tip 33 and the second precious metal tip 43 respectively, only one of the compositions may be selected to be within the range defined in the invention though it is preferable that both compositions are within the range defined in the invention.

Further, in the aforementioned embodiment, a plug of the type having the side electrode 4 located in front (on the lower side in FIGS. 1 and 2) of the center electrode 3 is used as the plug 100. The invention may be however applied to a plug of another type different in the form of the center electrode and the side electrode. For example, the invention may be applied to a plug of the type called "surface discharge type" or "semi-surface discharge type" in which a side surface of the center electrode and a leading end surface of the side electrode are located opposite to each other. Specifically, the invention can be applied to the composition of any precious metal member facing the spark discharge gap.

The invention claimed is:

1. A spark plug comprising:

a center electrode; and a side electrode located on at least one side of said center electrode so that a spark discharge gap is formed between said center electrode and said side electrode, wherein:

at least one of said center electrode and said side electrode includes a precious metal member facing said spark discharge gap; and said precious metal member contains Ir as a main component, 6.5 mass % to 22 mass % of Rh, 5.2 mass % to 24 mass % of Ru, and 0.4 mass % to 3.5 mass % of Ni.

2. The spark plug as claimed in claim 1, wherein said precious metal member contains 8 mass % to 20 mass % of Ru.

3. The spark plug as claimed in claim 1, wherein said precious metal member contains at least one of Pt, Pd, Re and Os.

4. The spark plug as claimed in claim 1, wherein said precious metal member contains an oxide (inclusive of a composite oxide) of an element selected from Sr, Y, La, Ce, Pr, Nd, Sm, Eu, Gd, Tb, Dy, Ho, Er, Tm, Yb, Lu, Ti, Zr and Hf.

5. The spark plug as claimed in claim 4, wherein said precious metal member contains at least one of $Y_2O_3$, $La_2O_3$, $ThO_2$ and $ZrO_2$.

6. A spark plug comprising:

a center electrode; and a side electrode located on at least one side of said center electrode so that a spark discharge gap is formed between said center electrode and said side electrode, wherein:

at least one of said center electrode and said side electrode includes a precious metal member facing said spark discharge gap; and said precious metal member contains Ir as a main component, Ru in a range of from 8 mass % to 20 mass %, Ni in an amount not smaller than 0.4 mass % and smaller than the mass % of Ru contained in said precious metal member, and Rh.

7. The spark plug as claimed in claim 6, wherein the precious metal member contains Rh in a range of from 0.3 mass % to 43 mass % and Ni in a range from 0.4 mass % to 19 mass %.

8. The spark plug as claimed in claim 6, wherein the precious metal member contains Rh in a range from 0.5 mass % to 36 mass %, and Ni in a range of 0.4 mass % to 11 mass %.

9. The spark plug as claimed in claim 6, wherein the precious metal member contains Rh in a range from 1 mass % to 31 mass %, and Ni in a range from 0.4 mass % to 7 mass %.

10. A spark plug comprising:

a center electrode; and a side electrode located on at least one side of said center electrode so that a spark discharge gap is formed between said center electrode and said side electrode, wherein:

at least one of said center electrode and said side electrode includes a precious metal member facing said spark discharge gap; and said precious metal member contains Ir as a main component, Ru in a range of from 8 mass % to 20 mass %; Rh in an amount not smaller than 0.3 mass % and not larger than a content of Ru contained in said precious metal member, and Ni.

11. The spark plug of claim 10, wherein the precious metal member contains 0.5 or more mass % of Rh, and Ni in a range from 0.4 mass % to 11 mass %.

* * * * *